United States Patent [19]

Galand

[11] Patent Number: 5,073,938

[45] Date of Patent: Dec. 17, 1991

[54] PROCESS FOR VARYING SPEECH SPEED AND DEVICE FOR IMPLEMENTING SAID PROCESS

[75] Inventor: Claude Galand, Cagnes sur Mer, France

[73] Assignee: International Business Machines Corporation, Armonk, N.Y.

[21] Appl. No.: 423,732

[22] Filed: Oct. 17, 1989

Related U.S. Application Data

[63] Continuation of Ser. No. 168,836, Mar. 16, 1988, abandoned.

[30] Foreign Application Priority Data

Apr. 22, 1987 [XH] Hague ..... 87430010

[51] Int. Cl.[5] ..... G10L 7/02

[52] U.S. Cl. ..... 381/34

[58] Field of Search ..... 381/29-41, 381/51-53; 364/513.5; 375/122

[56] References Cited

U.S. PATENT DOCUMENTS

| | | | |
|---|---|---|---|
| 3,462,555 | 8/1969 | Presti | 381/35 |
| ',816,664 | 6/1974 | Koch | 381/30 |
| 4,142,071 | 2/1979 | Croisier et al. | 179/15.55 |
| 4,216,354 | 8/1980 | Esteban et al. | 179/15.55 |
| 4,464,784 | 8/1984 | Agnello | 381/34 |
| 4,569,075 | 2/1986 | Nussbaumer | 381/34 |
| 4,700391 | 10/1987 | Leslie et al. | 381/35 |
| 4,700,393 | 10/1987 | Masuzawa et al. | 364/513.5 |
| 4,709,390 | 11/1987 | Atal et al. | 381/38 |
| 4,852,168 | 7/1989 | Sprague | 381/35 |

OTHER PUBLICATIONS

M. R. Portnoff, "Implementation of the Digital Phase Vocoder Using the Fast Fourier Transform", IEEE Trans. on Acoustic, Speech and Signal Processing, vol. ASSP 24, No. 3, pp. 243-248, Jun. 1976.

A. Croisier, D. Esteban, and C. Galand, "Perfect Channel Splitting by Use of Interpolation/Decimation/Tree Decomposition Techniques", International Conference on Information Sciences and Systems, vol. 2, pp. 443-446, Jun. '76.

H. J. Nussbaumer and C. Galand, "Parallel Filter Banks Using Complex Quadrature Mirror Filters (COMF)", Signal Processing II: Theories and Applications, North-Holland, N.Y., Sep. 1983, pp. 69-72.

H. J. Nussbaumer, C. Galand, and J. B. Perini, "Magnitude Phase Coding of Base-Band Speech Signals", IEEE Intn'l Conference on Acoustics, Speech and Signal Processing (ICASSP), Tokyo, Apr. 1986, pp. 2379-2382.

C. Galand, C. Contourier, G. Platel, R. Vermot-Gauchy, "Voice-Excited Predictive Coder (VEPC), Implementation on a High-Performance Signal Processor," IBM J. Res. Develop., vol. 29, No. 2, Mar. 1985, pp. 147-157.

*Primary Examiner*—Gary V. Harkcom
*Assistant Examiner*—John A. Merecki
*Attorney, Agent, or Firm*—John C. Smith

[57] ABSTRACT

The process for varying the speed of a speech signal that involves splitting at least a portion of the speech frequency bandwidth into N narrow sub-bands, processing each sub-hand signal contents to derive therefrom magnitude data M(i, n) and phase data P(i, n), i = 1, . . . , N being the subband index and n the time index. The M (i, n) sequence is converted into a sequence M'(n) by either duplicating one sample every K samples (K being an integer value derived from the desired slowing-down/speeding up ratio). The phase sequence P (i, n) is processed to derive therefrom an increment sequence D(i, n) = P(i, n) − P(i, n − 1), which increment sequence is first converted into a D'(i, n) sequence by either dropping or duplicating one sample every K, samples, before being converted into P'(i, n) = P'(i, n) + D'(i, n). The P'(i, n), D'(i, n) sequences are converted back into sub-band signals contents, then combined together into the slowed-down/speeded-up speech signal.

8 Claims, 5 Drawing Sheets

PROCESS FOR VARYING SPEECH SPEED AND DEVICE FOR IMPLEMENTING SAID PROCESS

This is a continuation of co-pending application Ser. No. 07/168,836 filed on Mar. 16, 1988, now abandoned.

BACKGROUND OF THE INVENTION

1. Technical Field

This invention relates to voice processing. In particular, with methods of speeding-up or slowing down speech messages.

2. Background Art

Sped speech, or variable speed speech usually denotes a means to either slow-down or speed-up recorded speech messages without altering their quality.

Such means are of great interest in voice processing systems, such as voice store and forward systems, wherein voice signals are stored for play-back later on at a varied, speed. They are particularly useful to operators looking for a specific portion of a recorded message, by speeding-up the play back to rapidly locate the portion looked for, and then slowing down the process while listening to the desired portion of the message. It should be noted that speed varying might conventionally be achieved with mechanical means whenever speech is stored in its analog form on moving memories. However, this would distort the signal pitch and, in addition, it would not apply to digital systems wherein speech is processed digitally.

A sophisticated method for implementing sped speech has been proposed by M. R. Portnoff in IEEE Trans. on Acoust., Speech and Signal Processing, Vol. ASSP 24, No. 3, pp. 243-248, June 1976 (Implementation of the digital phase vocoder using the Fast Fourier Transform). This method is based on adaptive measurement of the pitch period, and insertion or deletion of speech samples on a pitch period basis. This technique requires the accurate estimation of the pitch period, which is both complex and expensive to achieve, especially in applications involving telephone signals wherein the low part of the frequency bandwidth (0-300 Hz) including the pitch has been removed.

SUMMARY OF THE INVENTION

An object of this invention is to perform speech speed variation without requiring pitch measurement while providing a quality level equivalent to the one provided by methods based on pitch consideration. The proposed method presents a low complexity once associated with sub-band coding. It can also apply to Voice-Excited Predictive Coding (VEPC).

The above object is carried out by digitally speeding-up or slowing-down a speech message, splitting at least a portion of the considered speech signal bandwidth into several narrow subbands, converting each sub-band contents into phase/magnitude representation and then performing sample deletion/insertion over each sub-band phase and magnitude data, according to the desired speech rate variation, then recombining the sub-band contents into speech.

The foregoing and other objects, features, and advantages of the invention will be apparent from the following more particular description of a preferred embodiment of the invention, as illustrated in the accompanying drawings.

DESCRIPTION OF THE PREFERRED EMBODIMENT

This invention will be described for a digitally encoded voice signal in which the encoding did not involve band splitting. It will then be applied to split band coders. Speed variation, as used herein, applies both to speeding-up and to slowing-down digital speech information.

Figure 1:
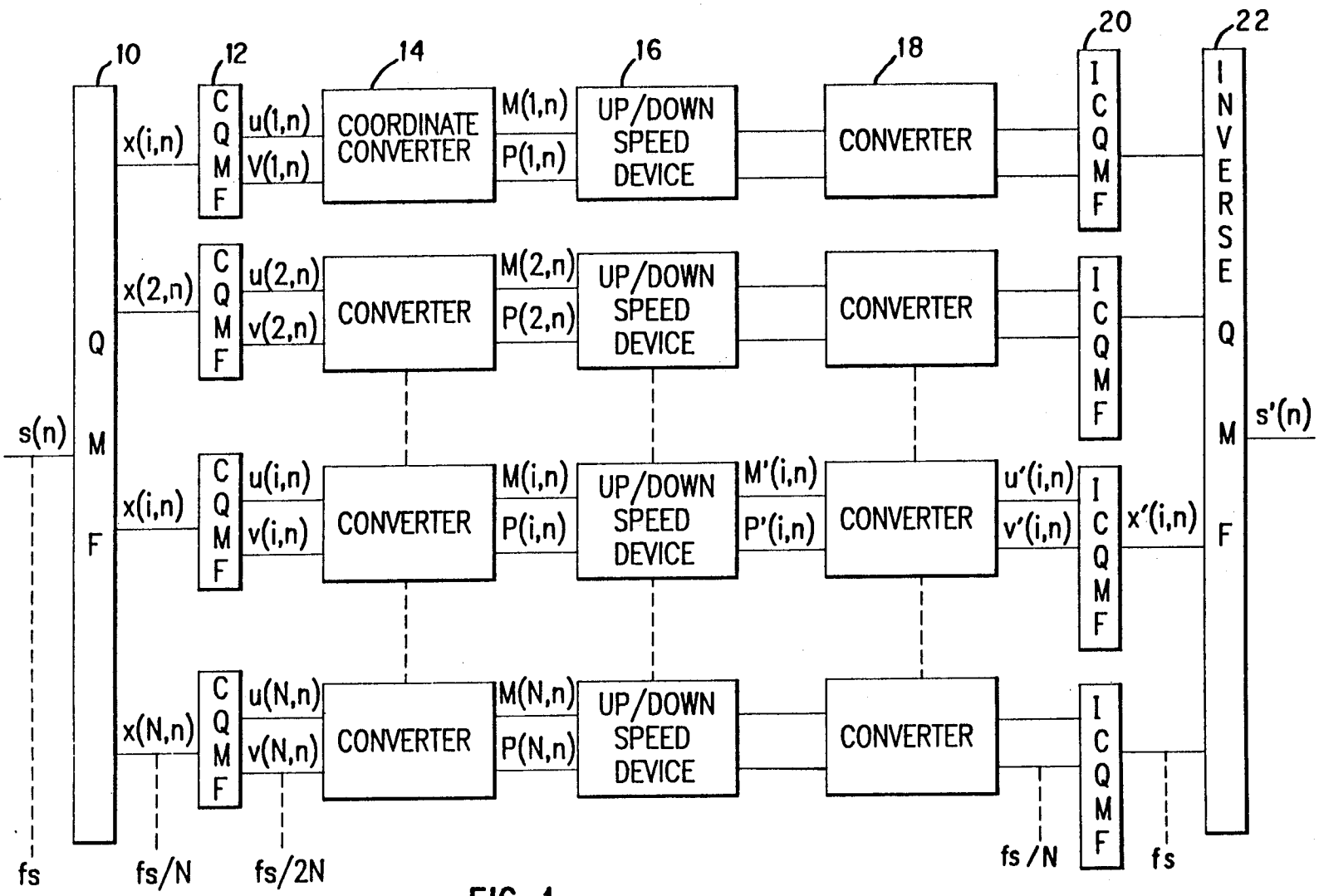
FIG. 1 is a block diagram of a preferred embodiment of this invention.

FIG. 1 shows a preferred embodiment of this invention. The speech signal s(n) representing the contents of a limited bandwidth of the voice signal to be processed, sampled at a given frequency (e.g. Nyquist) fs and digitally encoded is first split into N sub-bands by a bank of quadrature mirror filters (QMF) 10. QMF's are filters known in the voice processing art. The device 10 provides N sub-band signals x(1,n), x(2,n),..., x(N,n). The sub-band resolution must be high enough to catch the harmonic structure of the speech signal in all cases. Since the human pitch frequency can be as low as 80 Hz, a bank of filters providing N=40 sub-bands would be theoretically necessary to cover the telephone bandwidth (300-3400Hz).

Each sub-band signal is down sampled to a rate fs/N to keep a constant overall sample rate throughout the system. The sub-band signals x(i,n), with i=1, 2, ... N are fed into complex QMF filters (CQMF) 12, and processed to extract the analytical signal consisting of an in-phase component u(i,n), and a quadrature component v(i,n), which are down sampled by two by dropping every other sample.

In each sub-band, the in-phase u(n) and quadrature v(n) components of the signal are then processed by a cartesian to polar coordinates converter circuit 14 to derive a digital magnitude signal M(i,n) and a digital phase signal P(i,n) according to:

$$M(i,n) = (u^2(i,n) + v^2(i,n))^{\frac{1}{2}} \quad (1)$$

$$P(i,n) = \text{Arctg}\,\frac{v(i,n)}{u(i,n)} \quad (2)$$

i=1,2,.....,N denoting the considered sub-band. The magnitude signal M(i,n) and the phase signal P(i,n) of each sub-band (i=1,2,...,N) are then processed by up/-down speeding device 16. Device 16 provides speed varied couples of output signals M'(i,n) and P'(i,n) which are then recombined to cartesian coordinates in a converter 18 providing a couple of in-phase and quadrature components according to:

$$u'(i,n)=M'(i,n).\cos P'(i,n) \quad (3)$$

$$v'(i,n)=M'(i,n).\sin P'(i,n) \quad (4)$$

P'(i,n) being the phase information of the speed varied sub-band signal.

In each sub-band, the u' and v' components represent the original sub-band signal, at the new rate, and are then recombined by inverse complex quadrature mirror filters (ICQMF) 20. The resulting sub-band signals x'(i,n) are processed by a bank of inverse QMF filters 22 to generate the speed varied speech signal s'(n).

Figure 2:
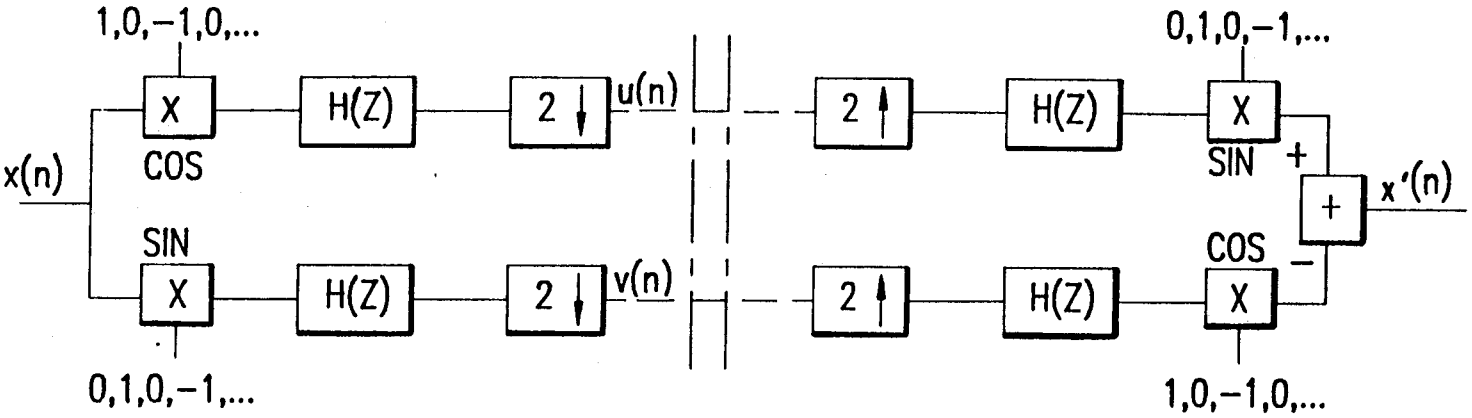
FIG. 2 is a circuit for performing the operations of CQMFs and ICQMFs.

FIG. 2 represents a circuit for performing the operations of CQMFs 12 and ICQMFs 20 (shown in FIG.1). Complex QMFs (CQMF) are known in the art. The circuit enables splitting a signal x(n) sampled at a frequency fs, into two signals u(n) and v(n) sampled at fs/2 and in quadrature phase relationship with each other. Then synthesizing back a speech signal x(n) from u(n) and v(n). Using CQMF techniques, the two quadrature signals u(n) and v(n) are derived from the real sub-band signal x(n) by:

$$U(Z)\tfrac{1}{4}\sum_{k=0}^{1}(X((-1)^k(jZ)^{\frac{1}{2}}) - X((-1)^k(-jZ)^{\frac{1}{2}}))\cdot H((-1)^kZ)^{\frac{1}{2}} \quad (5)$$

$$V(Z) = \tfrac{1}{4}j\sum_{k=0}^{1}(X((-1)^k(jZ)^{\frac{1}{2}}) - X((-1)^k(-jZ)^{\frac{1}{2}}))\cdot H((-1)^kZ)^{\frac{1}{2}} \quad (6)$$

where : SUM denotes a summing operation

X(Z), U(Z), V(Z) are the Z=transform of x(n), u(n) and v(n), and H(Z) is the Z transform of a low-pass M-tap CQMF filter, with M even. Assuming the linear distortion due to the CQMF filter (ripple) is ignored, then the magnitude M(n) and phase P(n) of x(n) can be evaluated from u(n) and v(n) according to equations (1) and (2).

In order to insure an accurate reconstruction, the filter H(Z) must have a 3dB attenuation at frequency fs/4N, and the magnitude H(w) of the Fourier transform must be such that:

$$H^2\left(w+\frac{ws}{4}\right)+H^2\left(w-\frac{ws}{4}\right)=1 \quad (7)$$

with $ws=2\pi.fs$ $w=2\pi.f$

In practice, the filter H(Z) must be sufficiently sharp to eliminate the cross-modulation appearing when computing (1) and (2).

Assuming now that the input speech signal x(n) has a harmonic structure and the respective sub-bands are rather narrow, with no aliasing, then each sub-band would contain a single harmonic. If the input signal is stationary, then the magnitude M(n) of each sub-band signal is constant and its phase P(n) varies linearly.

In fact, the speech signal is not stationary, but the above conditions are closely approximated. As a result, the magnitude M(n) of the signal in each sub-band is varying slowly (at the syllabic rate), and the phase P(n) of this same signal is varying almost linearly. Once converted into phase/magnitude data, the sub-band signals M(i,n) and P(i,n), are processed into an up/down device 16.

Practical up/down speeding ratios are as follows. In audio distribution systems, the ratio will be selected in the 0.5 to 2 range. In other words, the speech can be played at a minimum of half its original speed and at a maximum of twice its original speed. Practically, this range is not covered continuously, but through a few discrete values in the interval (0.5-2). The choices are not critical and the ratios for speeding up and slowing down the speech have been selected according to ratios K/K−1 and K/K+1 respectively, with the original speed being normalized to 1.

| Speed up. | ratio K/K − 1 |
|---|---|
| 2 | 2/1 |
| 1.5 | 3/2 |
| 1.25 | 5/4 |
| **Slow down** | **ratio K/K + 1** |
| .75 | 3/4 |
| .5 | 1/2 |

Figure 3:
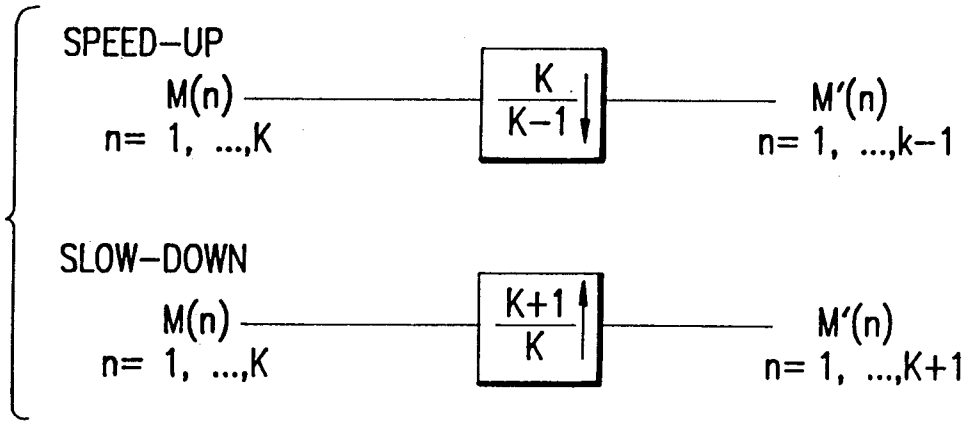
FIG. 3 is a schematic representation of the up/down operations to be performed over the magnitude data M(n) within each sub-band.

FIG. 3 shows a schematic representation of the up/-down operations to be performed over the magnitude data M(n) within each sub-band. For speeding up, the magnitude signals are simply decimated by the appropriate ratio. For example, assuming the desired speech speed should be doubled (K/K−1=2/1). Then, every second sample of the magnitude signal is just dropped. For a ratio of 1.5 , every third sample of the magnitude signal is suppressed. Generally speaking, for a K/K−1 ratio, every Kth sample of the magnitude signal M(n) is dropped. The operation on each block of K input samples M(n), n=1, ...K, is described by the following relations:

$$M'(n)=M(n)\ n=1,\ldots,K-1 \quad (8)$$

where M(n), n=1,...,K−1 represents the output sequence of magnitude samples.

For a slowing-down process, a similar operation is performed. For a K/K+1 ratio, every Kth sample of the magnitude signal is duplicated. The operation on each block of K input samples M(n), n=1,..,K is described by the following relations:

$$M'(n)=M(n)\ n=1,\ldots,K \quad (9)$$

$$M'(K+1)=M(K)$$

Where M'(n), n=1,...,K+1 represents the output sequence of magnitude samples.

For example, a 2 to 1 slowing down operation will result in a repetition of every M(n) sample to derive M'(n).

Figure 4:
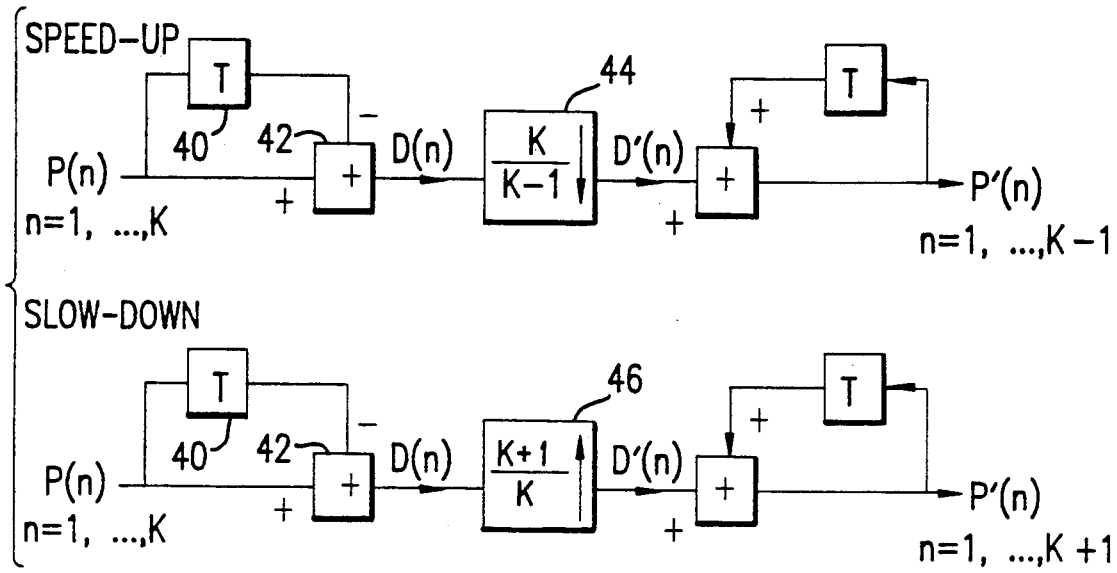
FIG. 4 is a circuit used within the up/down speed device of FIG. 1 for processing the phase signal P(n) within each sub-band.

Represented in FIG. 4 is the circuit used within the up/down speed device 16 for processing the phase signal P(n) within each sub-band The speed change over the phase signal is implemented as follows. The phase samples P(n) are first pre-processed to derive a difference signal or phase increment sequence D(n) using a one sample delay cell (T) 40 and a subtracter 42, both fed with the P(n) sequence:

$$D(n)=P(n)-P(n-1) \quad (10)$$

For a K/K−1 ratio speeding up, every Kth sample of the difference signal D(n) is dropped. The operation on each block of K input samples D(n), n=1,...,K, is made into device 44 according to:

$$D'(n)=D(n)\ n=1,...,K-1 \quad (11)$$

Where D'(n), n=1,...,K−1 represents the difference output sequence.

For a slowing down process, a similar operation is performed. Slowing down by a ratio K/K+1 is achieved through a duplication in device 46 of every Kth sample of the difference signal D(n). The operation on each block of K input samples D(n), n=1,...,K, is described by the following equations:

$$D'(n)=D(n)\ n=1,...,K$$

$$D'(K+1)=D(K)$$

where D'(n), n=1,...,K+1 represents the output sequence of the difference samples once slowed down.

In both slowing-down and speeding-up, the recovery of the phase samples from the difference samples is implemented, using a one sample period delay cell (T)40 and an adder (42), according to the following relation.

$$P'(n)=P'(n-1)+D'(n).$$

Also, in both slowing-down and speeding-up, the ratio might be different from K/K+1 or K/K−1 by deleting or inserting more than one sample per block of length K. The above described process enables implementing a sped speech system independently of any consideration about the source of the speech signal. It can thus be used in combination with any digital coder. But it is particularly well suited to sub-band coders (SBC) wherein harmonic analysis by QMF filers is already available. These coders are well known in the art.

In the sub-band coder, the input signal bandwidth is split into several sub-bands. Then the content of each sub-band is coded with quantizers dynamically adjusted to the respective sub-band contents. In other words, the bits (or levels) quantizing resources for the overall original bandwidth are dynamically shared among the sub-bands. In addition, assuming the coding method involved uses Block Companded PCM techniques (BCPCM), then, the coding is performed on a blocks basis. In other words, the coder's quantizing parameters are adjusted for predetermined length consecutive blocks of samples. For each block of samples the coder provides and multiplexes in its output: sub-band quantized samples S(i,j), i=1, ...,N being the sub-band index, and j the time index within a block; one quantizer step Q; and, N terms n'(i) each representing the number of bits dynamically assigned for quantizing the considered sub-band contents. In practice, it should be noted that other types of data than Q and n'(i) might be used as long as these quantizer step data enable recovering the step to be assigned to the inverse quantizing operations to be performed to convert quantized samples back into digitally encoded samples.

Figure 5:
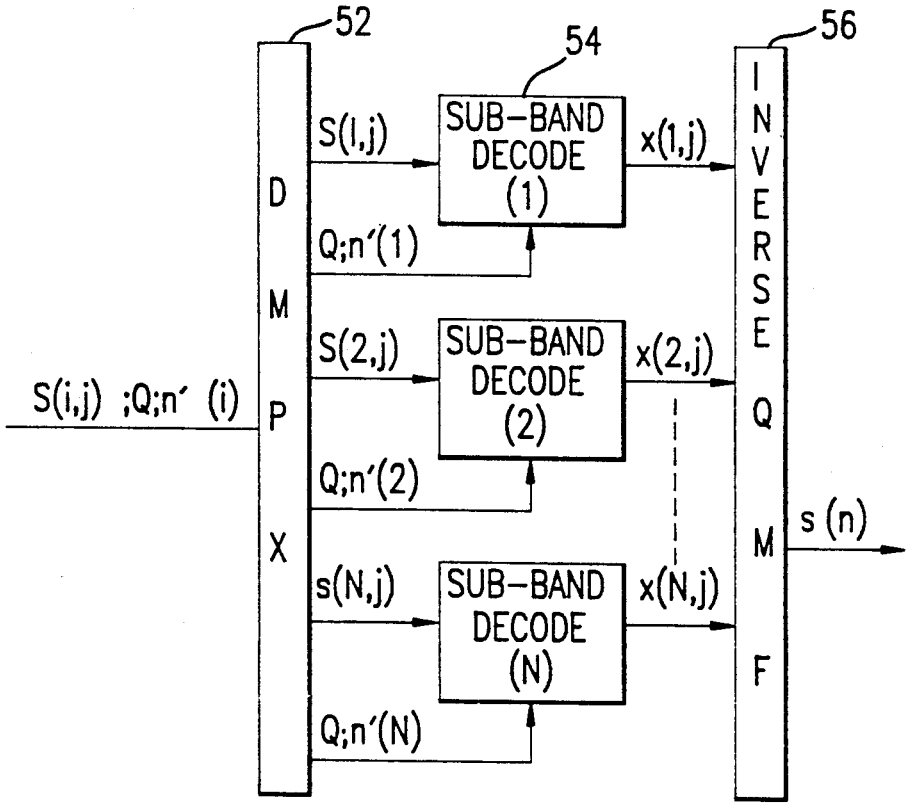
FIG. 5 is a block diagram of a synthesizer to be used to recombine data into the original voice signal.

Represented in FIG. 5 is a block diagram of the synthesizer to be used to recombine the S(i,j), Q and n'(i) data into the original voice signal s(n). The synthesizer input signal is first demultiplexed in demultiplexor (DPMX) 52 into its components before being sub-band decoded into a sub-band decoder 54. For that purpose, each sub-band decoder 54 is input with a block of quantized samples S(i,j) and controlled by Q and n'(i). Each sub-band decoder 54 outputs a set of digital coded samples x(i,j), which are input into an inverse QMF filter 56 which outputs a recombined speech signal s(n).

Figure 6:
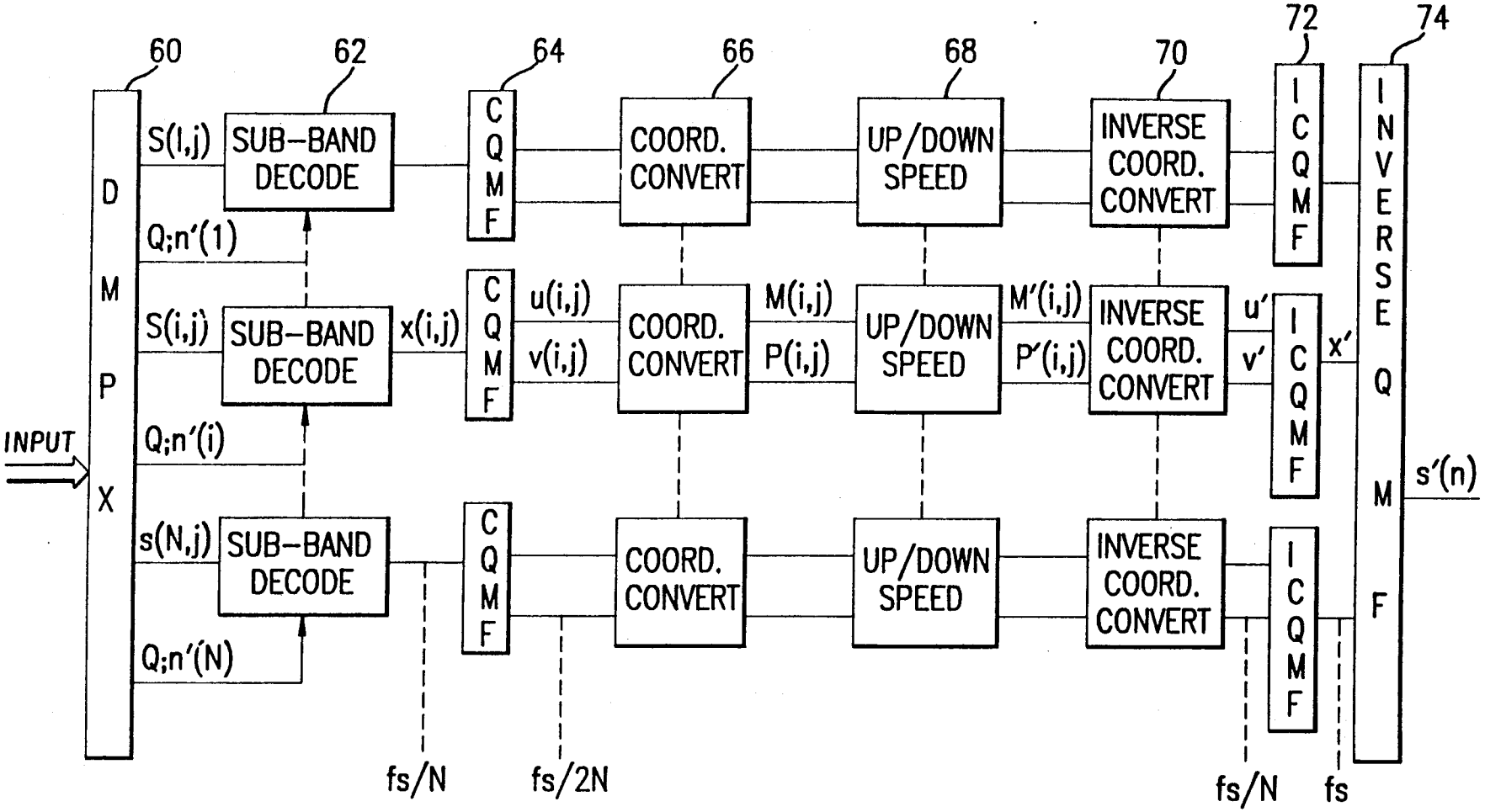
FIG. 6 is a block diagram of an embodiment using a split-band decoder.

FIG. 6 represents a block diagram of an embodiment of this invention applied to the split band decoder represented in FIG. 5. The sub-bands decoded signals x(i,j), sampled at fs/N are directly fed into Complex QMF filters 64 operating in the same manner as the CQMF filters 12 of FIG. 1. In other words, there is no need for the QMF filter bank 10 of FIG. 1, since perfect band splitting has already been performed in the coding process and completed by the demultiplexor 60 and sub-band decoder 62.

The remaining parts (64, 66, 68, 70, 72 and 74) are respectively made according to the circuits (12, 14, 16, 18, 20 and 22) of FIG. 1. Finally, the output signal s∝(n) is a speeded-up or slowed/down speech signal as required. Thus, applying this invention to the split band coded signal saves the bank of filters QMF 10.

The proposed sped speech technique may also be combined with the Voice Excited Predictive Coding (VEPC) process, since this type of coder involves using sub-band coding on the low frequency bandwidth (base band) of the voice signal. In addition, the bandwidth of each sub-band is narrow enough to ensure a proper operation of the sped speech device.

Figure 7:
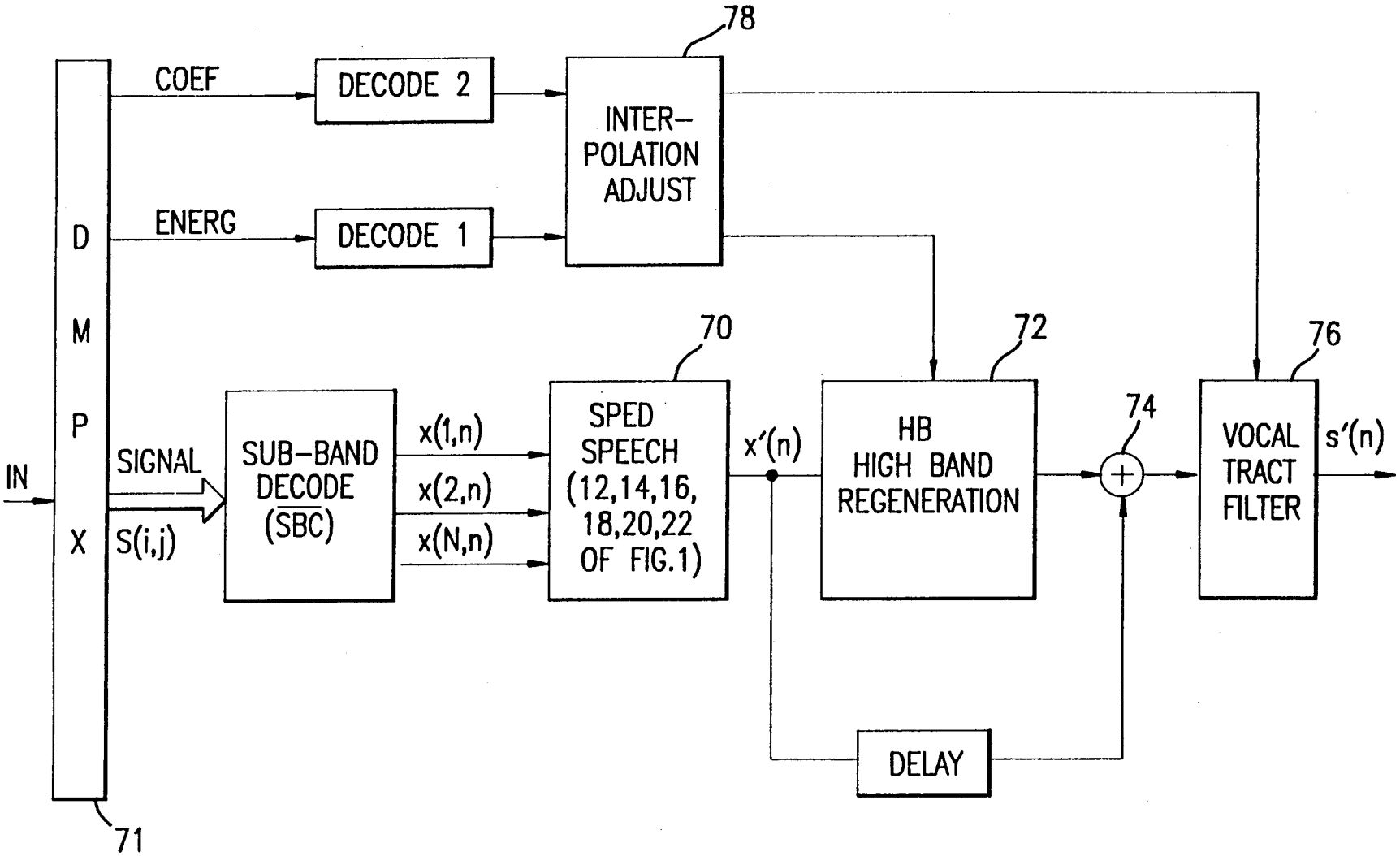
FIG. 7 is a block diagram showing the insertion of the invention into a prior art VEPC synthesizer.

Represented in FIG. 7 is a block diagram showing the insertion of the device of this invention within a prior art VEPC synthesizer. The base-band sub-band signals S(i,j) provided by an input demultiplexer DMPX(71) are decoded into a set of signals x(i,n), which are fed into a speed-up/slow down device (70) made according to this invention (see FIG. 1). The speeded-up/slowed-down base-band signal x'(n) is then used to regenerate the high frequency bandwidth (HB) modulated by the decoded (DECODE 1) high frequency energy (ENERG) in 72. Then high band signal and low band signal delayed to compensate for the transit time within device 72 are added together in device 74. The adder output then drives a vocal tract filter 76, the coefficients of which are adjusted with the decoded COEF data, and the output of which is the reconstructed speech signal s'(n).

The speech descriptors (high frequency energy (ENERG) and PARCOR coefficients (COEF)) are up-dated on a block basis and linearly interpolated. The sped speech operation concerning these parameters are achieved in device 78 by adjusting the linear interpolation step size to the new block length.

While the invention has been particularly shown and described with reference to preferred embodiments applying two specific split band coding techniques, it will be understood by those skilled in the art that various changes in detail may be made therein without departing from the spirit, scope, and teaching of the invention. Accordingly, the invention herein disclosed is to be limited only as specified in the following claims.

We claim:

1. An apparatus for digitally varying the speed of a speech signal having a speech frequency bandwidth without measuring or substantially varying the pitch of the speech signal, including:

means for splitting at least a portion of the speech frequency bandwidth of said speech signal into a plurality of consecutive narrow sub-band signals;

means for processing each of said sub-band signals to derive therefrom phase samples and magnitude samples representative of the sub-band signal contents expressed in polar coordinates;

means for speed varying said sub-band signals by repeating phase and magnitude samples or deleting samples therefrom at a rate depending upon the desired slowing-down or speeding-up rate respectively;

means for recombining each sub-band phase and magnitude samples into a speed varied sub-band signal; and means for recombining said speed varied sub-band signals into recombined speech, whereby said recombined speech is a speed varied version of said speech signal having substantially the same pitch as said speech signal.

2. An apparatus for speed varying a speech signal sampled at frequency fs without measuring or substantially varying the pitch of the speech signal, characterized in that it includes:

a first bank of quadrature mirror filters (QMF) for splitting a limited bandwidth of said speech signal into a plurality of N narrow sub-band signals, N being an integer value greater than 1;

first down sampling means, connected to said QMF bank for down sampling each of said sub-band signals at a rate fs/N;

complex quadrature mirror filtering (CQMF) means connected to said first down sampling means for converting each down sampled sub-band signal into an analytical signal represented by in-phase and quadrature components;

second down sampling means connected to said CQMF for down sampling said in-phase and quadrature components to fs/2N;

coordinate converting means connected to said second down sampling means for converting said analytical signal into magnitude component M(i,n) samples and phase component P(i,n) samples, with i=1. . ., N being the sub-band index and n being the time index;

speed variation means connected to said coordinate converting means for deleting or repeating samples of said magnitude component M(i,n) and said phase component P(i,n) at a rate depending upon the desired speech rate variation whereby M'(i,n) data are generated from said magnitude component M(i,n) and P'(i,n) data are generated from said phase component P(i,n);

coordinate converting means connected to said speed variation means for converting said M'(i,n) and P'(i,n) into rate converted analytical data u'(i,n) and v'(i,n) respectively;

inverse complex QMF filtering means (ICQMF) connected to the output of said coordinate converting means for up sampling said rate converted analytical data u'(i,n) and v'(i,n) to a rate fs; and, an inverse QMF filter bank connected to the output of said ICQMF means for providing a speed varied speech signal s'(n), said speed varied speech signal s'(n) having a pitch substantially the same as said speech signal.

3. A method for digitally varying the speed of a speech signal without measuring or substantially varying the pitch of the speech signal, said method comprising the steps of:

splitting at least a portion of the speech frequency bandwidth of said speech signal into a plurality of consecutive narrow sub-band signals;

processing each of said sub-band signals to derive therefrom phase samples and magnitude samples representative of the subband signal contents expressed in polar coordinates;

speed varying said sub-band signals by repeating phase and magnitude samples or deleting samples therefrom at a rate depending upon the desired slowing-down or speeding-up rate respectively;

recombining each of said speed varied sub-band phase and magnitude samples into a speed varied sub-band signal; and recombining said recombined speed varied sub-band signals into recombined speech, whereby said recombined speech is a speed varied version of said speech signal having substantially the same pitch as said speech signal.

4. The method according to claim 3 wherein said sub-band processing to derive phase and magnitude samples includes:

deriving from each of said sub-band signals an analytical signal consisting of an in-phase component and a quadrature component through use of complex quadrature mirror filtering techniques;

sampling-down said analytical signal by dropping every other sample from said in-phase and quadrature components; and, converting said sampled down analytical signal into phase and magnitude samples.

5. A method according to claim 3 wherein said sub-band signal is sped-up at a rate K/K-1, with K being an integer having a value greater than 1, including dropping one out of K magnitude samples; and dropping one out of K phase samples.

6. The method according to claim 3 wherein said sub-band signal is slowed down at a rate K/K+1, with K being an integer having a value grater than 0, including computing a phase sample and repeating said computed phase sample and one magnitude sample every K samples.

7. The method according to claim 3 wherein said portion of the speech frequency and width is limited to the speech signal base-band.

8. An apparatus for speed varying a speech signal sampled at frequency fs, characterized in that it includes:

a first bank of quadrature mirror filters (QMF) for splitting a limited bandwidth of said speech signal into a plurality of N narrow sub-band signals, N being an integer value greater than 1;

first down sampling means, connected to said QMF bank for down sampling each of said sub-band signals at a rate fs/N;

complex quadrature mirror filtering (CQMF) means connected to said first down sampling means for converting each down sampled sub-band signal into an analytical signal represented by in-phase and quadrature components;

second down sampling means connected to said CQMF for down sampling said in-phase and quadrature components to fs/2N;

coordinate converting means connected to said second down sampling means for converting said analytical signal into magnitude component M(i,n) samples and phase component P(i,n) samples, with $i=1, \ldots, N$ being the sub-band index and n being the time index;

speed variation means connected to said coordinate converting means for deleting or repeating samples of said magnitude component M(i,n) and said phase component P(i,n) at a rate depending upon the desired speech rate variation whereby M'(i,n) data are generated from said magnitude component M(i,n) and P'(i,n) data are generated from said phase component P(i,n); said speed variation means further including:

means for generating a sequence of magnitude signal components M(n) for each sub-band of said magnitude component M(i,n);

means for generating a sequence of phase signal components P(n) for each sub-band of said phase component P(i,n);

means for speeding up said speech signal at a rate $K/K-1$ K being a predetermined integer having a value greater than 1, including, for each sub-band:

means for converting the sequence of magnitude signal components M(n) into a speeded-up M'(n) by deleting every Kth M(n) sample;

means for generating a phase increment component sequence D(n) according to $$D(n)=P(n)-P(n-1)$$

means for converting the D(n) component sequence into D'(n) by deleting every Kth sample from D(n); and, means for generating a speeded-up phase sequence P'(n) with:

$$P'(n)=P'(n-1)+D'(n)$$

means for slowing down the speech signal at a rate $K/K+1$ K being a predetermined integer having a value greater than 0, including for each sub-band:

means for converting the sequence of magnitude signal components M(n) into a slowed-down sequence M'(n) by repeating every Kth M(n) sample;

means for generating a phase increment component sequence D(n) according to $$D(n)=P(n)-P(n-1)$$

means for converting the D(n) component sequence into D'(n) by duplicating every Kth sample and;

means for generating a slowed-down phase sequence

P'(n) with:

$$P'(n)=P'(n-1)+D'(n)$$

coordinate converting means connected to said speed variation means for converting said M'(i,n) and P'(i,n) into rate converted analytical data u'(i,n) and v'(i,n) respectively;

inverse complex QMF filtering means (ICQMF) connected to the output of said coordinate converting means for up sampling said rate converted analytical data u'(i,n) and v'(i,n) to a rate fs; and, an inverse QMF filter bank connected to the output of said ICQMF means for providing a speed varied speech signal s'(n).

* * * * *